US008011943B2

(12) United States Patent
Chang

(10) Patent No.: US 8,011,943 B2
(45) Date of Patent: Sep. 6, 2011

(54) ELECTRICAL CONNECTOR AND ASSEMBLY HAVING SAME

(75) Inventor: Jen-Tsorng Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/712,372

(22) Filed: Feb. 25, 2010

(65) Prior Publication Data

US 2011/0065292 A1 Mar. 17, 2011

(30) Foreign Application Priority Data

Sep. 17, 2009 (CN) ..... 2009 1 0307190

(51) Int. Cl.
*H01R 4/50* (2006.01)

(52) U.S. Cl. ..... 439/341

(58) Field of Classification Search ..... 439/341, 439/342, 862, 376, 929, 289, 326
See application file for complete search history.

(56) References Cited

U.S. PATENT DOCUMENTS 6,939,172 B2 * 9/2005 Lu ..... 439/607.2
2008/0045070 A1 * 2/2008 Zheng et al. ..... 439/370

* cited by examiner

*Primary Examiner* — Phuong Dinh
(74) *Attorney, Agent, or Firm* — Altis Law Group, Inc.

(57) ABSTRACT

An exemplary electrical connector for connecting an electronic device to a main circuit board is provided. The electronic device includes a secondary circuit board. The electrical connector includes an insulating housing shell, a first sidewall, a second sidewall facing the first sidewall, and a third sidewall interconnecting the first and second sidewalls. The first, second and third sidewalls cooperatively define a housing space. There is an electrically conductive member mounted at the third sidewall. The electrically conductive member is electrically connected to the main circuit board. The housing space is configured for housing the electronic device therein in a manner so as to enable the secondary circuit board of the electronic device to be electrically connected to the electrically conductive member.

15 Claims, 4 Drawing Sheets

ELECTRICAL CONNECTOR AND ASSEMBLY HAVING SAME

BACKGROUND

1. Technical Field

The present disclosure relates to electrical connectors, and particularly to an electrical connector for electrically connecting an electronic device, for example, a camera module, to a main circuit board.

2. Description of Related Art

Camera modules are commonly mounted in electronic devices such as cellular mobile phones and the like. The camera modules usually include a lens module and an image sensor. A plurality of terminals is formed on the image sensor of the camera module, and the terminals are fixedly connected to a main circuit board of the electronic device by reflow soldering technology. Thus, images captured by the camera module can be shown by the cellular mobile phone.

However, during manufacturing, if the camera module proves to be sub-standard during testing then it will be discarded along with the main circuit board it is connected to even if the circuit board has no problem.

BRIEF DESCRIPTION OF THE DRAWINGS

Many aspects of the present electrical connector and assembly can be better understood with reference to the following drawings. The components in the drawings are not necessarily drawn to scale, the emphasis instead being placed upon clearly illustrating the principles of the present electrical connector and assembly. Moreover, in the drawings, like reference numerals designate corresponding parts throughout the several views.

DETAILED DESCRIPTION

Figure 1:
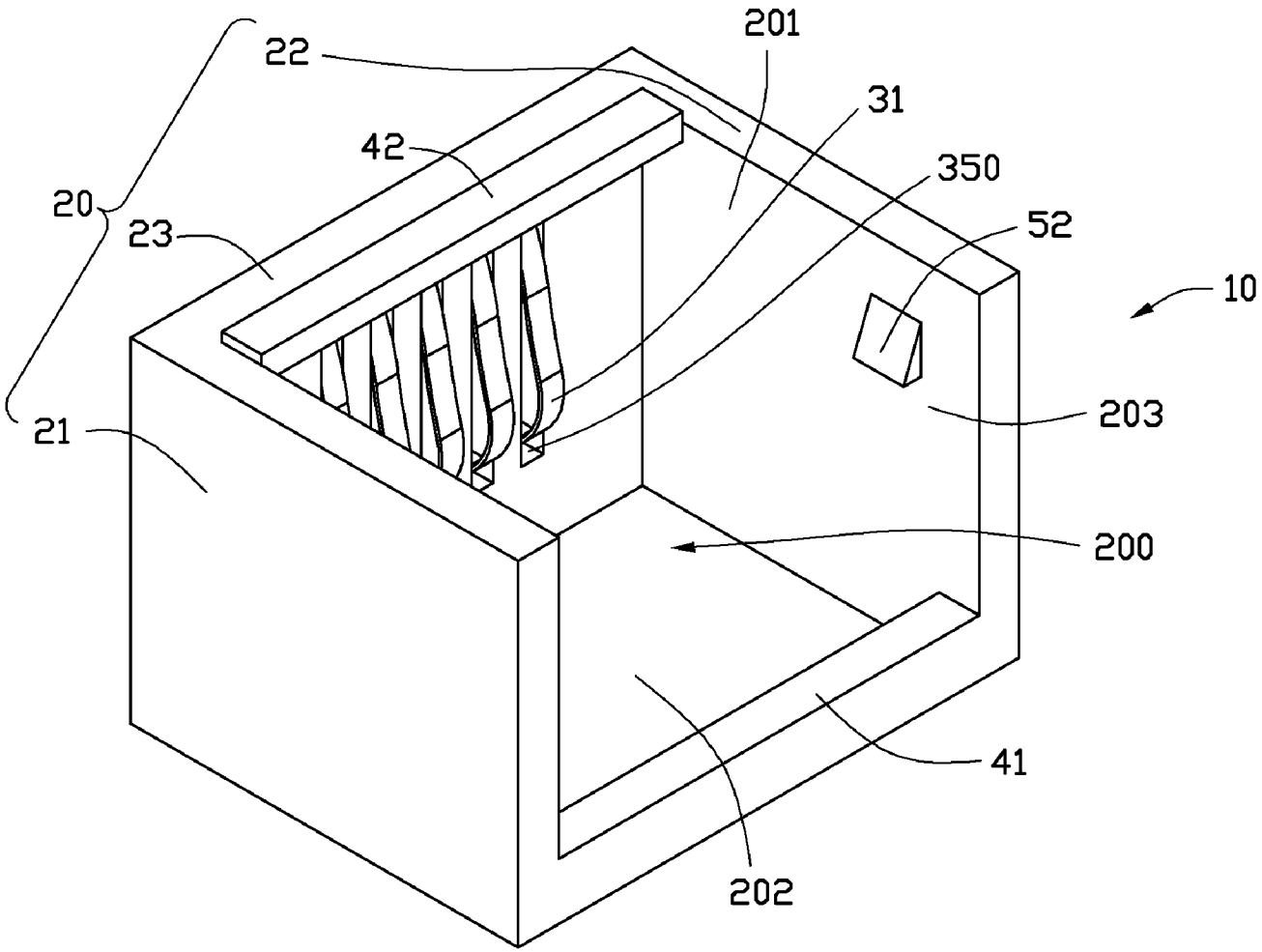
FIG. 1 is a perspective view of an electrical connector in accordance with an exemplary embodiment.
Figure 2:
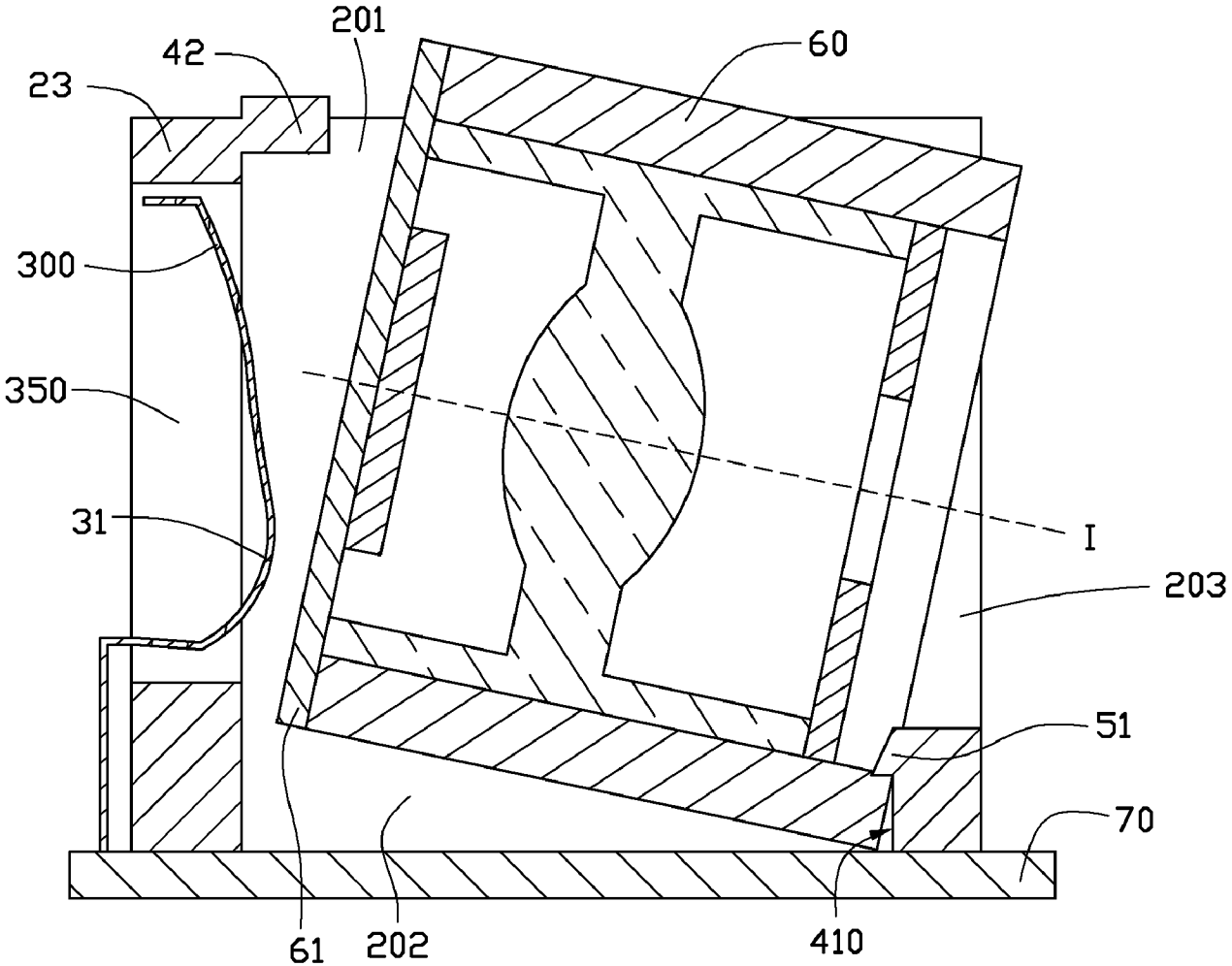
FIG. 2 is a side cross-sectional view of the electrical connector of FIG. 1, showing the electrical connector mounted on a main circuit board, and showing a process of putting a camera module into the electrical connector.
Figure 3:
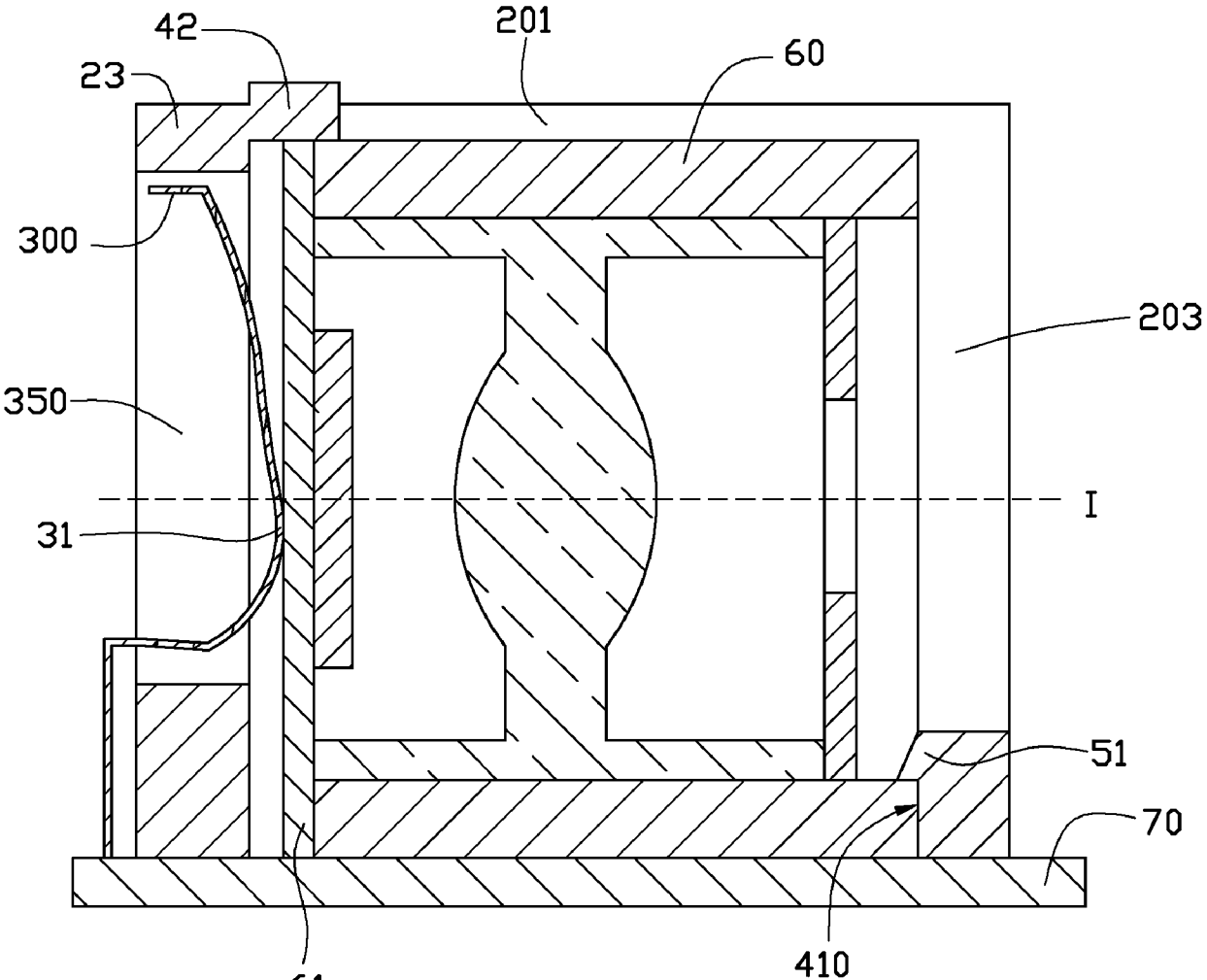
FIG. 3 is similar to FIG. 2, but showing the camera module housed in the electrical connector.
Figure 4:
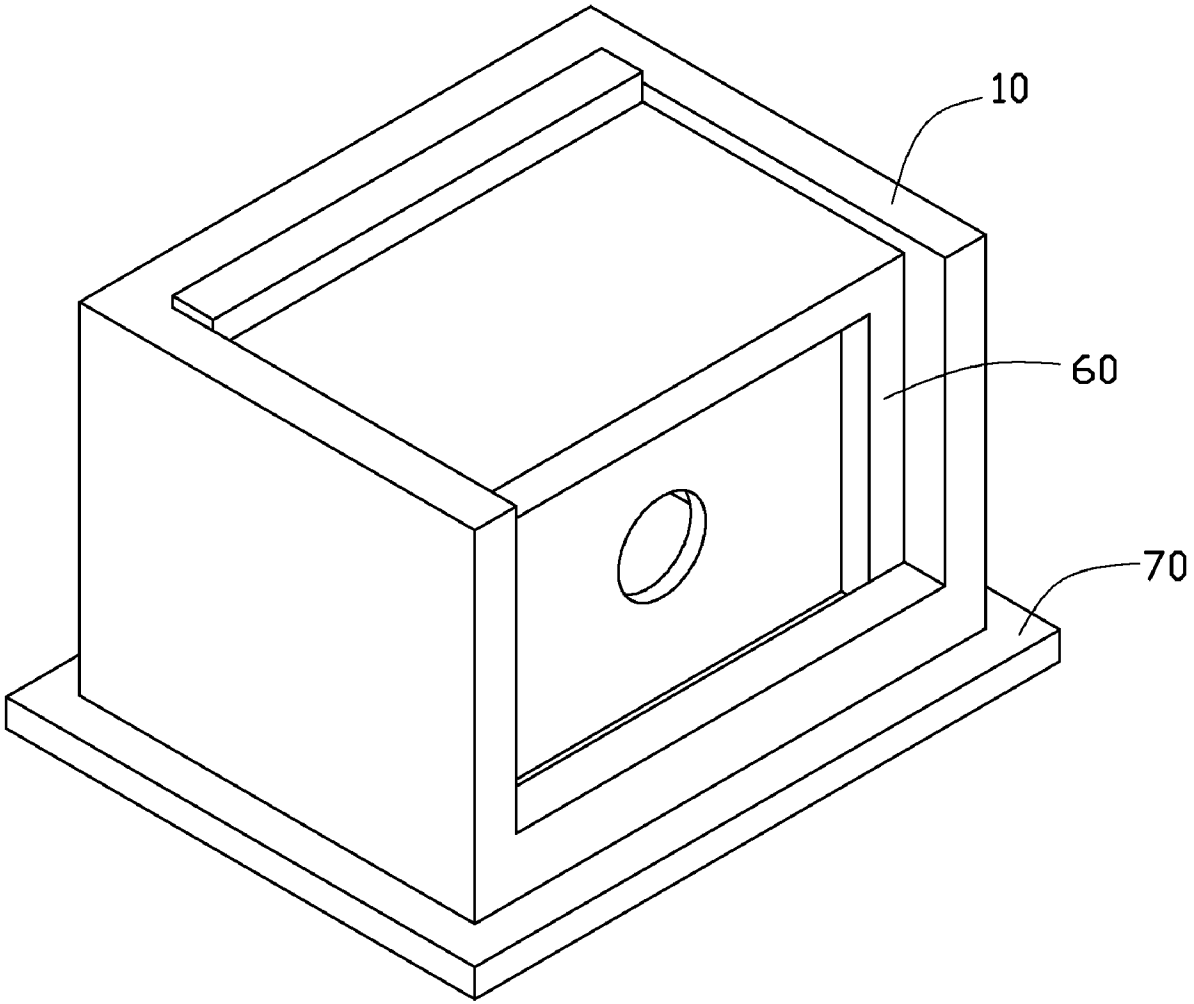
FIG. 4 is a perspective view of FIG. 3.

FIG. 1 shows an electrical connector 10 for electrically connecting a camera module 60 (see FIGS. 2-4) to a main circuit board 70 (see FIGS. 2-4) of a cellular mobile phone (not shown), in accordance with an embodiment. The electrical connector 10 is packaged in the cellular mobile phone. The camera module 60 includes a barrel, a lens, an aperture, an image sensor, and a secondary circuit board 61.

The electrical connector 10 mainly includes an insulating housing shell 20 and a plurality of terminals 300. The housing shell 20 is formed into a square-shaped box with a top opening 201, a bottom opening 202, and a side opening 203. The housing shell 20 includes a first sidewall 21, a second sidewall 22, and a third sidewall 23 that cooperatively define a housing space 200. The first sidewall 21 faces the second sidewall 22. The third sidewall 23 interconnects the first sidewall 21 and the second sidewall 22, facing the side opening 203. The third sidewall 23 is perpendicular to the first sidewall 21 and the second sidewall 22.

A plurality of parallel terminals 300 is mounted on the third sidewall 23 for contacting with the secondary circuit board 61 of the camera module 60. The terminals 300 are made of resilient conductive material. The terminals 300 are connected to the main circuit board 70. The terminals 300 each have a contact portion 31 slightly protruding from the third sidewall into the housing space for engaging with the secondary circuit board 61. A plurality of parallel slots 350 is formed in the third sidewall 23 to receive the respective terminals 300.

The main circuit board 70 is disposed at the bottom opening 202 of the housing space 200. That is, the bottom opening 202 of the housing shell 20 is covered by the main circuit board 70. The main circuit board 70 is perpendicular to the first sidewall 21, the second sidewall 22, and the third sidewall 23.

The camera module 60 defines an optical axis I. The optical axis I is perpendicular to the secondary circuit board 61. The camera module 60 is inserted into the housing space 200, and the secondary circuit board 61 contacts at least one of the contact portions 31, thereby gaining an electrical connection between the camera module 60 and the electrical connector 10. Signals of the camera module 60 can be transmitted from the terminals 300 via the contact portion 31 to the circuit (not shown) of the main circuit board 70.

The camera module 60 is inserted into the electrical connector 10 from the top opening 201 or the side opening 203 of the housing space 200 after the main circuit board 70 is disposed at the bottom opening 202 or before that. In the end, the camera module 60 is completely accommodated in the housing space 200.

A first bar 41 is provided. The first bar 41 interconnects ends of the first sidewall 21 and the second sidewall 22 which are opposite to the ends of the first sidewall 21 and the second sidewall 22 where the third sidewall 23 is provided. The first bar 41 is for blocking the received camera module 60 from moving in a direction away from the third sidewall 23. The first bar 41 is located on the main circuit board 70. The first bar 41 has an inner surface 410 facing the third sidewall 23. There is a first resilient member 51 protruding out of the inner surface 410 and toward the third sidewall 23. The first resilient member 51 is configured for blocking the received camera module 60 from moving in a direction away from the bottom opening 202.

A second bar 42 connecting the first sidewall 21 and the second sidewall 22 is configured for blocking the camera module 60 from moving in a direction toward the top opening 201. The second bar 42 is adjacent to the third sidewall 23 and located on the top of the housing shell 200.

The second sidewall 21 has a second resilient member 52 attached thereto for increasing the friction between the second sidewall 22 and the camera module 60 so as to fix the camera module 60 firmly. It is understood that another second resilient member can be attached to the first sidewall 21 in the housing space 200.

Because the terminals 300 are pressed against the image sensor 61, the signals can be transferred from the camera module 60 to the main circuit board 70. Because the camera module 60 can be easily taken out of the electrical connector 10, advantageously, both the terminals 300 and the electrical connector 10 will not be damaged or liable to be discarded due to damage.

According to the present electrical connector 10, the camera module 60 is disposed relative to the main circuit board 70 with the optical axis I parallel to the main circuit board 70.

Although the electrical connector 10 of this disclosure is designed to attach the camera module 60 to another device, the electrical connector 10 of the disclosure is not limited to use with camera modules only, but may be applied to accommodate other modules, for example, a memory module.

It is understood that the terminals 300 can be replaced by other conductive members, such as conductive pads. The terminals 300 or conductive pads can be soldered to the inner surface of the third sidewall 23 and electrically connected to the main circuit board 70 as well. In this case, the slots 350 are not necessary.

It is understood that the above-described embodiments are intended to illustrate rather than limit the disclosure. Variations may be made to the embodiments without departing from the spirit of the disclosure. Accordingly, it is appropriate that the appended claims be construed broadly and in a manner consistent with the scope of the disclosure.

What is claimed is:

1. An electrical connector for electrically connecting an electronic device to a main circuit board, the electronic device comprising a secondary circuit board, the electrical connector comprising:

an insulating housing shell comprising a first sidewall, a second sidewall facing the first sidewall, and a third sidewall interconnecting the first and second sidewalls at first ends of the first and second sidewalls, the first, second and third sidewalls cooperatively defining a housing space;

an electrically conductive member mounted at the third sidewall and electrically connected to the main circuit board, the housing space configured for housing the electronic device therein in a manner so as to enable the secondary circuit board of the electronic device to be electrically connected to the conductive member; and a first bar interconnecting the first sidewall and the second sidewall, wherein the first bar is arranged at opposite second ends of the first and second sidewalls and is configured for blocking the received electronic device from moving in a direction away from the third sidewall.

2. The electrical connector according to claim 1, wherein the conductive member comprises a plurality of parallel terminals.

3. The electrical connector according to claim 2, wherein each of the terminals comprises a contact portion protruding from the third sidewall into the housing space, for engaging with the secondary circuit board.

4. The electrical connector according to claim 3, wherein the third sidewall comprises a plurality of slots receiving the respective terminals.

5. The electrical connector according to claim 1, wherein the housing shell further comprises a bottom opening cooperatively defined by the first sidewall, the second sidewall and the third sidewall, and facing toward the main circuit board, and a first resilient member protrudes from the first bar toward the third sidewall, the first resilient member configured for blocking the received electronic device from moving in a direction away from the bottom opening.

6. The electrical connector according to claim 5, further comprising a second bar interconnecting the first sidewall and the second sidewall, wherein the housing shell further comprises a top opening opposite to the bottom opening, and the second bar is located on the housing shell in the top opening and is configured for blocking the electronic device from moving in a direction toward the top opening.

7. The electrical connector according to claim 5, wherein a second resilient member is formed on the second sidewall in the housing space.

8. An assembly, comprising:

an insulating housing shell comprising a first sidewall, a second sidewall facing the first sidewall, and a third sidewall interconnecting the first and second sidewalls at first ends of the first and second sidewalls, the first, second and the third sidewalls cooperatively defining a housing space with a plurality of openings, wherein the openings comprises a top opening, an opposite bottom opening, and a side opening opposite the third sidewall;

a main circuit board perpendicular to the first, second, and third sidewalls, wherein the main circuit board is located under the bottom opening and shields the bottom opening;

a conductive member mounted at the third sidewall and electrically connected to the main circuit board;

an electronic device having a secondary circuit board, wherein the electronic device is received in the housing space and faces the side opening, and the secondary circuit board is in contact with the conductive member;

a first bar interconnecting the first sidewall and the second sidewall, the first bar arranged at opposite second ends of the first and second sidewalls and configured for blocking the received electronic device from moving in a direction away from the third sidewall; and a second bar located on the housing shell in the top opening and interconnecting the first sidewall and the second sidewall, and configured for blocking the electronic device from moving in a direction toward the top opening.

9. The assembly according to claim 8, wherein the conductive member comprises a plurality of parallel terminals.

10. The assembly according to claim 9, wherein the third sidewall comprises a plurality of slots receiving the respective terminals.

11. The assembly according to claim 8, wherein the housing shell further comprises a first resilient member protruding from the first bar toward the third sidewall, the first resilient member configured for blocking the received electronic device from moving in a direction away from the bottom opening.

12. The assembly according to claim 11, wherein a second resilient member is formed on the second sidewall in the housing space.

13. A camera module assembly comprising:

an insulating housing shell comprising:

a first sidewall, a second sidewall facing the first sidewall, and a third sidewall interconnected between the first sidewall and the second sidewall at first ends of the first and second sidewalls, a top opening and an opposite bottom opening both cooperatively defined by the first, second and third sidewalls, and a side opening, the third sidewall facing the side opening of the housing shell;

a main circuit board perpendicular to the first sidewall, the second sidewall, and the third sidewall, wherein the main circuit board is located under the bottom opening and shields the bottom opening;

a resilient electrically conductive member mounted at the third sidewall and electrically connected to the main circuit board;

a camera module defining an optical axis and comprising a secondary circuit board, wherein the camera module is housed in the housing space, the optical axis is perpendicular to the secondary circuit board and parallel with the main circuit board, and the secondary circuit board contacts the conductive member;

a first bar interconnecting the first sidewall and the second sidewall, the first bar arranged at opposite second ends of the first and second sidewalls and configured for blocking the received electronic device from moving in a direction away from the third sidewall; and a second bar located on the housing shell in the top opening and interconnecting the first sidewall and the second sidewall, and configured for blocking the camera module from moving in a direction toward the top opening.

14. The camera module assembly according to claim 13, wherein the conductive member comprises a plurality of parallel terminals located on the third sidewall.

15. The camera module assembly according to claim 14, wherein the third sidewall comprises a plurality of slots therein receiving the respective terminals.

* * * * *